United States Patent [19]

Hopkins

[11] 3,987,993

[45] Oct. 26, 1976

[54] PAINT CAN SUPPORT AND BRUSH RECEPTACLE

[76] Inventor: Jeffrey E. Hopkins, 78 Fairfield Ave., Danville, Va. 24541

[22] Filed: Dec. 22, 1975

[21] Appl. No.: 643,502

[52] U.S. Cl. ..... 248/210; 248/110; 248/311.1

[51] Int. Cl.[2] ..... E06C 7/14

[58] Field of Search ..... 248/210, 211, 311, 110, 248/111, 226 A, 226 B, 226 R, 238, 246

[56] References Cited

UNITED STATES PATENTS

| | | | |
|---|---|---|---|
| 1,468,372 | 9/1923 | Bendlin | 248/226 B |
| 2,748,977 | 6/1956 | Sarchet | 248/110 |
| 2,990,152 | 6/1961 | Whitney | 248/226 A |
| 3,131,900 | 5/1964 | Anderson et al. | 248/311 R |
| 3,182,943 | 5/1965 | Crossman | 248/210 |
| 3,317,171 | 5/1967 | Kramer | 248/311 R |
| 3,407,429 | 10/1968 | Dinardo | 248/110 |

*Primary Examiner*—Robert A. Hafer

[57] ABSTRACT

A combination paint can support and brush receptacle is releasably clamped to the side rail of a ladder and is freely pivotal about the clamp for maintaining a level can and brush well regardless of ladder inclination. In addition, the brush receptacle is an open top pocket conveniently positioned between the paint can support and the clamp to provide a convenient depository for brushes when not in use.

3 Claims, 1 Drawing Figure

PAINT CAN SUPPORT AND BRUSH RECEPTACLE

SUMMARY OF THE INVENTION

The present invention is directed to an apparatus of the type which is attached to a painter's ladder and on which a paint can may be deposited within easy access of a painter on the ladder. Further the apparatus includes a pocket into which brushes may be deposited when not in use. Structurally the apparatus includes a clamping means releasably attached to the side rail of the ladder. A brush pocket or well includes front and rear walls, one of which is attached to the clamping means. A support arm depends from the other of the front and rear walls and carries a can receptacle at the lower end thereof. The brush receptacle includes inclined front and rear walls joined at the bottom and spaced apart at the top with a pair of end walls connecting the corresponding ends of the front and rear walls. The front wall of the receptacle is joined to the upper end of the aforementioned support arm, and a pivotal connecting device joins the rear wall with the aforementioned clamping means whereby the can support is freely pivotal regardless of ladder inclination.

The clamping means by which the can and brush receptacle is attached to the ladder includes a base plate having threaded a mounting post extending perpendicularly therefrom and onto which a clamping plate is received. A tightening nut includes inner threads corresponding to the outer threads on the mounting post, and provides the means for tightening the clamping plate and base plate against opposite surfaces of the side rail of the ladder.

So arranged, the paint can levels itself regardless of the inclination of the ladder, and both the paint can and the brush receptacle are kept convenient to the painter at all times. The arrangement provides easy access to the paint can, as well as providing a brush storage place that is easily accessible, and into which brushes may be inserted with a minimum of searching and manipulation.

It is therefore an object of the present invention to provide a painter's accessory whereby paint cans and brushes may be appropriately maintained in a location easily accessible to a painter on a ladder.

It is a further object of the present invention to provide a device of the type described which will maintain the paint can level regardless of the ladder inclination.

Further, it is an object of the present invention to provide a device of the type described, which, in addition to receiving a paint can, receives paint brushes, not in use, in a convenient, easily accessible location.

Other objects and a fuller understanding of the invention will become apparent after a consideration of the following detailed description of the preferred embodiment read in conjunction with the accompanying drawing in which:

The single FIGURE is a perspective view illustrating the present invention;

DETAILED DESCRIPTION OF A PREFERRED EMBODIMENT

Figure 1:
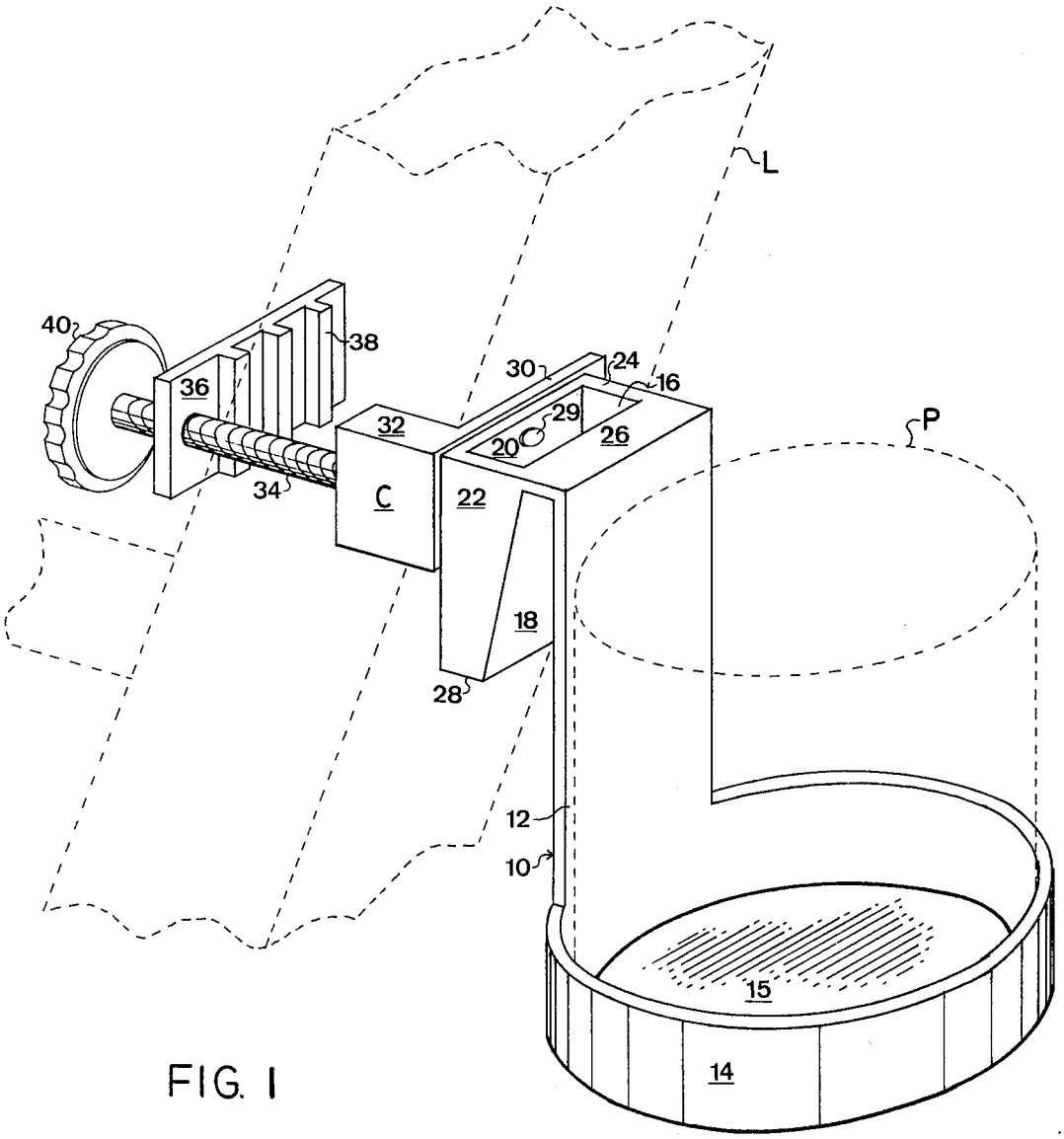

In the drawing there is illustrated a device for suspending a paint can P from the side rail L of a ladder and for providing a receptacle for brushes B, as well as the paint can P, within easy access to a painter on the ladder. The device includes a can support means 10, a brush support means 16, and a clamping means C. The brush support means 16 is secured to and extends inwardly of the upper end of can support means 10, and is pivotally connected to the clamping means C, whereby the paint can may self-level itself regardless of ladder inclination. The brush support means 16 is generally in the form of a pocket or well with an open top into which brushes B may be easily inserted when not in use. There is no need to secure the brush to any kind of clamping element at all, and it is only necessary for the painter to insert the bristles of the brush down into the well to insure that the brush will be maintained in an easily accessible position to resume painting.

More specifically, the can support means 10 includes an upstanding support arm or plate 12 having a can receptacle 14 extending outwardly from the lower end thereof. Receptacle 14 is generally a circular strip of material approximately 2–3 inches high with a solid bottom portion 15. Alternately, the bottom portion might be crossed strips of material, it not being necessary to have a solid bottom therein, as long as sufficient material exists therein to support the paint can.

The brush receptacle 16 includes an inclined front wall 18 and a generally vertically extending rear wall 20, the front and rear walls 18,20 forming a V-shaped pocket or well in which the front and rear walls are joined by bottom wall 28 at the bottom thereof and are spaced apart at the top. A pair of end walls 22,24 join the ends of front and rear walls 18,20 to form a brush receptacle or well which is enclosed on all sides and the bottom with an open top. The upper edge of front wall 18 and the upper end of support arm 12 are connected at 26, and the entire structure which includes the can support 10 and the brush pocket 16 may be integrally formed. Alternatively, although not shown, the can support 10 and brush receptacle 16 could be formed separately and secured together in some suitable manner at 26.

The clamping means C includes a base plate 30 which is generally arranged in parallel relationship with rear wall 20 of the brush receptable 16. A side portion 32 extends perpendicularly from plate 30 and includes an exteriorly threaded mounting post or extension 34. A clamping plate 36, having an opening 37 therein, is received on mounting post 34 and further includes, if desired, a plurality of gripping lugs 38. In assembled condition, the clamping plate 36 is received on mounting post 34, and an interiorly threaded nut 40 is turned onto the threaded portion of mounting post 34. As the nut is turned, the clamping plate 36 is caused to move toward base plate 30, thereby gripping the side rail of the ladder L therebetween.

A pivotal connecting means, as for example, a rivet 29, freely pivotally joins rear wall 20 of the brush receptacle 16 with the base plate 30 of clamping means C through corresponding openings in the rear wall 20 and base plate. So arranged, when the clamping means C is secured to the ladder rail L, and a paint can P is positioned within the can support 10, the can support will seek a level position, thereby preventing spillage of paint during use thereof.

Further, the paint brush receptacle 16 is positioned in a convenient position for use by the painter and provides a pocket into which a brush may be easily introduced, whereby time is not wasted trying to secure the brush to some type of clamping means, which unduly prolongs the painting operation. The support according to the present invention thereby provides a convenient and easily accessible paint can support and brush receptacle, which can be releasably attached to the ladder rail at any position, can be easily moved up and down the ladder, and keeps the paint can level regardless of the ladder inclination.

Various modifications may be possible without departing from the scope of the present invention, which is set forth in the following claims.

What is claimed is:

1. Device for suspending a paint can and brush receptacle from the side rail of a ladder within easy access to a painter on the ladder comprising:

A. a clamping means for releasably mounting said device to said side rail;

B. can and brush support means including:

i. an upstanding support arm;

ii. a can receptacle extending outwardly from the lower end of said support arm;

iii. a brush receptacle extending between and connecting the upper end of said support arm and said clamping means and comprising:

a. front and rear walls joined at the bottom and spaced apart at the top;

b. a pair of end walls connecting the corresponding ends of said front and end walls;

c. said front wall joined to the upper end of said support arm; and d. a pivotal connecting means joining said rear wall and said clamping means, whereby said can and brush support means is freely pivotal regardless of ladder inclination to maintain the paint can level to prevent spillage.

2. The device according to claim 1 wherein said clamping means includes:

a. base plate having mounting post extending perpendicularly therefrom at one end thereof, said post having exterior advancing screw threads thereon;

b. clamping plate having an opening therethrough at one end thereof, said mounting post extending through said opening; and c. tightening nut received on said mounting post adjacent the outer surface of said clamping plate, whereby as said nut is screwed onto said mounting post the clamping plate is moved closer to said base plate.

3. The device according to claim 1 wherein said pivotal connecting means comprises a rivet extending through said rear wall of the brush receptacle and said base plate of the clamping means.

* * * * *